US006619205B2

(12) United States Patent
Maier

(10) Patent No.: US 6,619,205 B2
(45) Date of Patent: Sep. 16, 2003

(54) INKING DEVICE

(75) Inventor: Peter Maier, Worms (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/169,094

(22) PCT Filed: Dec. 2, 2000

(86) PCT No.: PCT/DE00/04292

§ 371 (c)(1),
(2), (4) Date: Jul. 11, 2002

(87) PCT Pub. No.: WO01/53098

PCT Pub. Date: Jul. 26, 2001

(65) Prior Publication Data

US 2003/0000401 A1 Jan. 2, 2003

(30) Foreign Application Priority Data

Jan. 18, 2000 (DE) ..... 100 01 764

(51) Int. Cl.[7] ..... B41F 31/00
(52) U.S. Cl. ..... 101/350.5; 101/367
(58) Field of Search ..... 101/350.1, 350.5, 101/364, 366, 367, 487, 488, 365, 350.6

(56) References Cited

U.S. PATENT DOCUMENTS

| | | | | | |
|---|---|---|---|---|---|
| 2,891,471 | A | | 6/1959 | Sengewald | |
| 4,152,986 | A | * | 5/1979 | Dadowski | 101/463.1 |
| 4,401,024 | A | * | 8/1983 | Frentress | 101/248 |
| 5,046,420 | A | * | 9/1991 | Sondergold et al. | 101/488 |
| 5,121,689 | A | * | 6/1992 | Fadner | 101/365 |
| 5,226,364 | A | * | 7/1993 | Fadner | 101/366 |
| 5,381,733 | A | | 1/1995 | Hirashima | |
| 5,671,678 | A | * | 9/1997 | Bolte et al. | 101/491 |
| 5,749,293 | A | | 5/1998 | Ota et al. | |
| 6,065,402 | A | * | 5/2000 | Feller et al. | 101/350.5 |

FOREIGN PATENT DOCUMENTS

| | | |
|---|---|---|
| DE | 622890 | 12/1935 |
| DE | 41 08 883 A1 | 9/1992 |
| DE | 42 05 713 C2 | 8/1994 |
| DE | 93 10 680.7 | 1/1995 |
| DE | 197 36 339 A1 | 4/1999 |
| EP | 0 333 011 | 9/1989 |
| EP | 0 655 328 B1 | 5/1995 |
| GB | 256588 | 12/1926 |
| GB | 346994 | 4/1931 |
| WO | WO 98/50233 | 11/1998 |

* cited by examiner

*Primary Examiner*—Eugene H. Eickholt
(74) *Attorney, Agent, or Firm*—Jones, Tullar & Cooper, PC

(57) ABSTRACT

An inking device is used to ink a cylinder or a roller of an intaglio printing inking unit. A doctor blade device is located in the vicinity of the ink level of the printing ink in an ink trough of the ink application device. The ink trough, the doctor blade device and the cylinder or roller to be inked can be heated. This allows the use of solvent-free printing inks at temperatures in the range of 100° C.

16 Claims, 2 Drawing Sheets

INKING DEVICE

FIELD OF THE INVENTION

The present invention is directed to an ink application device for a rotary printing press. The printing ink and at least a portion of the doctor blade arrangement are heated.

BACKGROUND OF THE INVENTION

A rotogravure inking device has become known from EP 655 328 B1. A doctor device is arranged remote from the ink duct and closely in front of the printing zone in order to prevent the premature drying of the solvent-containing printing ink.

DE 93 10 680 U1 describes an arrangement for setting the temperature of printing ink in the inking device of a printing press. No doctor device resting against a roller is provided there.

WO 98/50233 A shows a rotogravure inking device. A doctor blade is arranged below a horizontal line extending through the axis of rotation of the forme cylinder.

DE 197 36 339 A1 describes a temperature-adjusting device for a screen roller with a doctor blade.

DE 42 05 713 C2 discloses rotogravure ink, which is used for printing in a warmed state and which dries by cooling.

SUMMARY OF THE INVENTION

The object of the present invention is directed to providing an ink application device for a forme cylinder used with rotogravure printing. Printing inks, whose working temperatures lie above the ambient temperature, can be used for printing.

In accordance with the present invention, this object is attained by providing printing ink in an ink trough of an ink application device for rotogravure printing on a rotary printing press. The printing ink in the ink trough has a working temperature higher than ambient. At least parts of a doctor blade arrangement in the ink application device are capable of being heated. A contact line of a doctor blade of the doctor blade arrangement is below a horizontal line that extends through the axis of rotation of a forme cylinder in the rotary printing press.

The advantages which can be obtained by the present invention rest, in particular, in that removal of the printing ink from the roller, or from the forme cylinder, by use of a doctor blade, takes place in the immediate vicinity of the ink level of the printing ink in the ink trough. This results in a short distance for the printing ink, removed by a doctor blade from the roller to be inked, to fall. In this way, faults because of splashes when the removed ink drops into the ink duct, are held to a minimum. An ink foam, which would otherwise be created, is also prevented, so that soiling of the inking device does not occur.

Because of the ability to preset the temperature of the printing ink, it is possible to also use so-called hot-tec printing inks for rotogravure printing. In this context, see DE 42 05 713 C2. These printing inks are applied without solvents at a temperature of approximately 100 to 110° C. to the material to be printed.

Only a negligible heat loss is noted because of a compact arrangement of the parts of the inking device which come into contact with the hot-tec printing ink.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
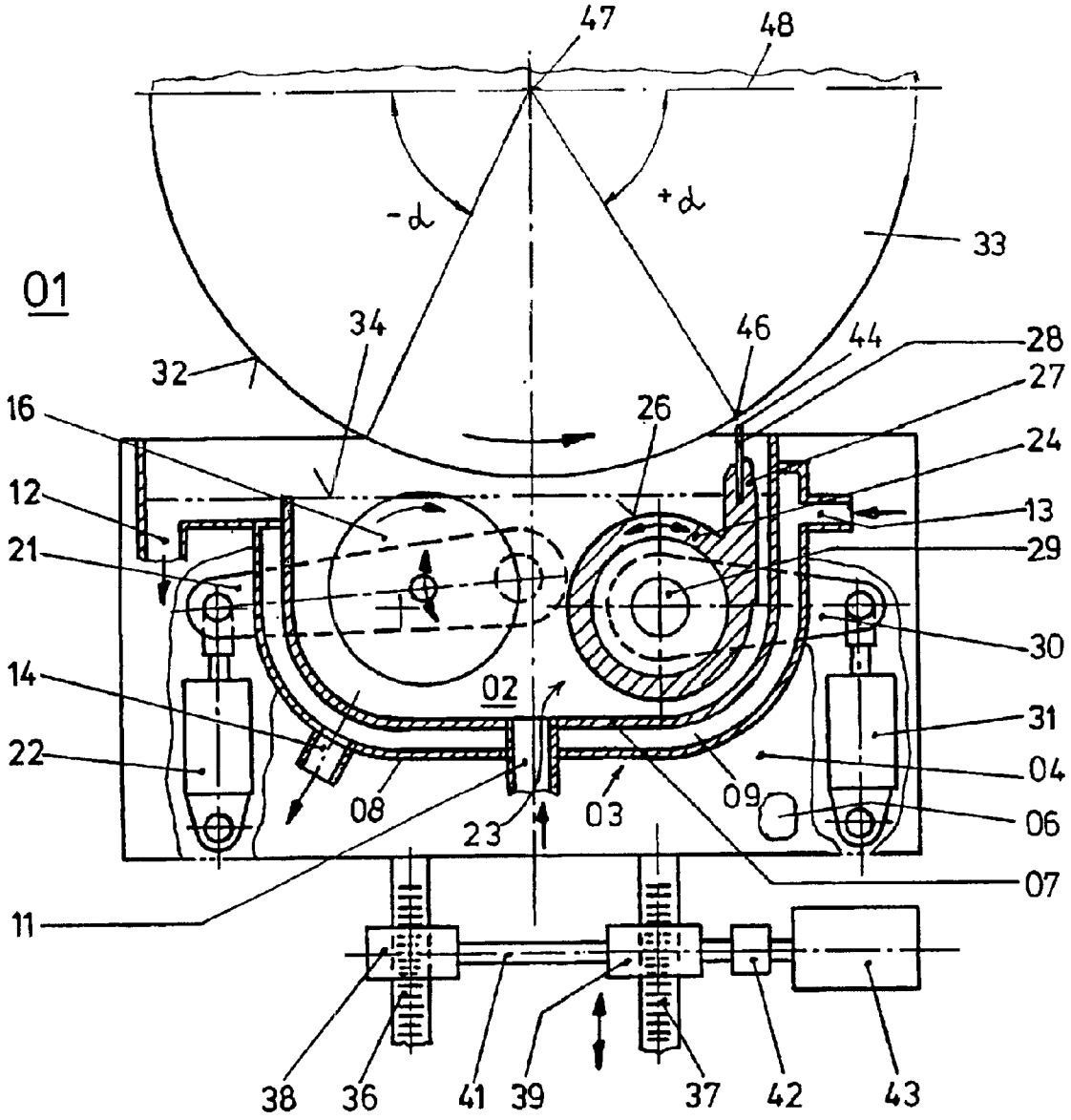
FIG. 1, a cross sectional view through an ink application device in accordance with the present invention in a position of rest, and in FIG. 2, a top plan view of the ink application device in accordance with FIG. 1 in a partial representation and without a forme cylinder.
Figure 2:
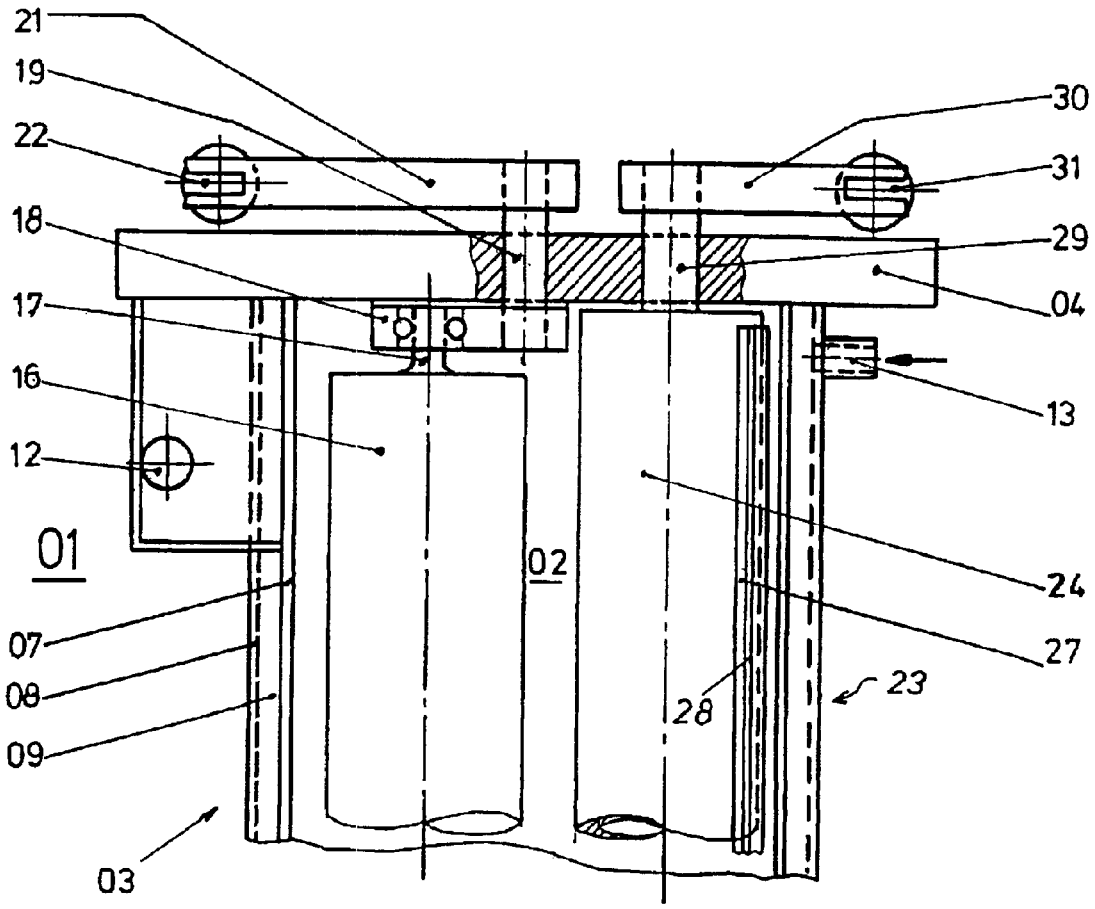

An ink application device 01 of an ink unit of a rotary printing press consists of an ink trough 03 containing printing ink 02, which ink trough 03 is fastened at both ends on end plates 04, 06, which end plates 04, 06 are fixed in place in lateral frames of a rotary printing press, all as seen in FIGS. 1 and 2. The ink trough 03 preferably consists of a double-walled container, i.e. of an inner and outer container 07, 08, between which is defined a hollow space 09 for receiving a heatable fluid, for example warmth-distributing oil.

The inner container 07 is provided with an ink inlet line 11 and with an ink outlet line 12. The outer container 08 is provided with a warming fluid inlet line 13, as well as a warming fluid outlet line 14. The ink level is maintained constant in the ink trough 03 by the placement of the ink outlet line 12 at a defined height.

An ink application device, for example an inking roller 16, is located inside the ink trough 03, and is supported at both ends on pivotable inner levers 18, as seen in FIG. 2. In turn, the pivotable inner levers 18 are each fastened, fixed against relative rotation, on a lever shaft 19 which is passed through the end plates 04, 06. Outside of the end plates 04, 06, each lever shaft 19 is connected, fixed against relative rotation, with a respective outer lever 21, each of which outer levers 21 can be pivoted into a position of rest, as depicted in FIG. 1, or into an operating position, not specifically represented, by utilization of a work cylinder 22, as shown in both FIGS. 1 and 2.

A doctor blade arrangement, shown generally at 23, is also arranged in the ink trough 03. Doctor blade arrangement 23 consists, for example, of a cylindrical doctor blade support 24, which has a clamping strip 27 extending in the tangential direction in respect to a surface area 26 of the doctor blade support 24, as well as in an axis-parallel direction. A doctor blade 28 made, for example, of spring steel, is maintained in the doctor blade support 24 by the clamping strip 27. The clamping strip 27 is fixedly arranged on the doctor blade support 24.

The doctor blade support 24 has journals 29 that extend through the end plates 04, 06. Each such journal 29 is connected outside of the end plates 04, 06, fixed against relative rotation, with a piston rod of a work cylinder 31 by a lever arm 30. When the work cylinder 31 is actuated, the doctor blade support 24 rotates, so that the doctor blade 28 can be placed against a surface area 32 of a roller to be inked, for example the surface area 32 of a forme cylinder 33 for rotogravure printing, or a screen roller which is provided with surface area depressions. The roller, or the forme cylinder 33 is embodied so it can be warmed, at least on its surface area.

With respect to the roller, or the forme cylinder 33, the doctor blade arrangement 23 is arranged in such a way that a contact line 46, defined by a line of contact between a working edge 44 of the doctor blade 28, which is in the working position, and the surface 32 of the roller or cylinder 33 to be inked extends on the surface area 32 of the forme cylinder 33 below a horizontal line 48 extending through an axis of rotation 47 of the forme cylinder 33. Contact line 46 is situated within an angular range α of between 40° and 70°, preferably in a range −+α of 50° to 60°, and in particular at an angle a of 55°, in respect to the horizontal line 48.

The ink trough 03 is dimensioned in such a way that an ink level 34 is maintained in the ink trough 03 so that in their position of rest, the inking roller 16, as well as the doctor blade arrangement 23, are almost completely covered by printing ink 03. The clamping strip 27 is at least partially bathed in printing ink.

Each of the end plates 04, 06 are interlockingly connected with separate toothed racks 36, 37, as seen in FIG. 1. The toothed racks 36, 37 are displaceably seated in guide elements 38, 39 fixed in place in the lateral frames. Pinion gears are arranged on a driveshaft 41 and are in engagement with the teeth of the toothed racks 36, 37.

The driveshaft 41 is connected via, a coupling 42, with a step motor 43, which is seated, fixed in place, in the lateral frames. A counting device, not specifically represented, is used as the indicator of the actual height setting of the ink trough 03 in relation to the forme cylinder 33. The roller, or the forme cylinder 33 can be exchanged and can thus have diameters of different sizes.

In accordance with a variation of the preferred embodiment, it is possible to heat the doctor blade 28 separately. This can be accomplished, for example, in that the doctor blade holder 27 can be embodied so that it can be heated, for example electrically, near the clamped portion of the doctor blade 28.

For the separate heating of the doctor blade 28, it is also possible to arrange an induction coil located on the rim of the inner container 07 and extending in an axis-parallel direction.

In the rotogravure printing process, it is possible to arrange a counter-cylinder, which is not specifically represented, and which acts against the forme cylinder 33. The assumed direction of rotation of the forme cylinder 33 is counterclockwise, as depicted in FIG. 1. The rotation direction can also be clockwise. However, for this direction of rotation it would be necessary to exchange the lateral arrangement of the inking roller 16, as well as of the doctor blade arrangement.

The ink application device in accordance with the present invention operates as follows: the ink trough 03 is vertically displaced in the direction toward the forme cylinder 33 and is matched to the diameter of the latter. This displacement of the ink trough 03 is accomplished by actuation of the step motor 43, the pinion gears and the toothed racks 36 and 37, as discussed above. Preheated printing ink 02, in the approximate temperature range between 60° C. to 180° C., and preferably between 100° C. and 110° C., is filled into the inner container 07 of ink trough 03. The hollow space 09 located between the inner and outer containers 07, 08 is filled with heated warming oil of a similar temperature.

The warming oil can be heated or warmed outside of, as well as inside of the hollow space 09.

The inking roller 16, as well as the doctor blade 28, can now be placed against the surface area 32 of the forme cylinder 33 while in the working position.

Following the termination of the printing process the printing ink 02 remains warmed until the start of the next printing process.

It is, of course, also possible to work with solvent-containing printing ink.

While a preferred embodiment of an inking device in accordance with the present invention h as been set forth fully and completely hereinabove, it will be apparent to one of skill in the art that various changes in, for example the drive for the forme cylinder, the source of heat for the ink warming fluid and the like could be made without departing from the spirit and scope of the present invention which is to be limited only by the following claims.

What is claimed is:

1. An ink application device useable to apply printing ink on a forme cylinder for rotogravure printing on a rotary printing press, said ink application device comprising:

an ink trough adapted to receive printing ink, said printing ink having a working temperature greater than ambient temperature, said printing ink filling said ink trough to a preset ink level;

a doctor blade arrangement in said ink trough, said doctor blade arrangement including a doctor blade support and a doctor blade;

means for heating at least said doctor blade support; and a contact line defined by contact of said doctor blade with the forme cylinder, said contact line being below a horizontal line extending through an axis of rotation of the forme cylinder, said doctor blade support being located below said preset ink level.

2. The ink application device of claim 1 wherein said doctor blade support is rotatable and further wherein said doctor blade arrangement includes a doctor blade clamping strip on said doctor blade support.

3. The ink application device of claim 2 wherein said clamping strip includes a clamping strip surface and wherein said clamping strip surface is located at least partially below said preset ink level.

4. The ink application device of claim 1 wherein said ink trough is a double-walled container.

5. The ink application device of claim 4 wherein said double walled container defines a hollow space, said hollow space being adapted to receive a fluid which can be warmed.

6. The ink application device of claim 1 wherein said ink trough includes an ink inlet line and an ink outlet line, said ink outlet line being arranged at said preset ink level.

7. The ink application device of claim 1 further including means for separately heating at least said doctor blade of said doctor blade arrangement.

8. The ink application device of claim 7 wherein said separate heating means is an induction heater.

9. The ink application device of claim 1 further including means to warm at least a surface portion of the forme cylinder.

10. The ink application device of claim 1 wherein said contact line is located at an angle of between 50° to 60° below said horizontal line.

11. The ink application device of claim 1 further including means to warm at least a surface of the forme cylinder.

12. The ink application device of claim 1 further including an inking roller.

13. The ink application device of claim 1 further including actuating means for placing said doctor blade against the forme cylinder.

14. The ink application device of claim 13 further including means supporting said inking roller for movement into and out of engagement with the forme cylinder.

15. The ink application device of claim 1 wherein at least portions of said doctor blade arrangement are bathed in said printing ink having a working temperature greater than ambient temperature.

16. The ink application device of claim 1 wherein said ink working temperature is between 60° C. and 180° C.

* * * * *